US005690993A

United States Patent [19]

Malhotra et al.

[11] Patent Number: 5,690,993

[45] Date of Patent: Nov. 25, 1997

[54] OVERCOATED MIGRATION IMAGING MEMBERS

[75] Inventors: Shadi L. Malhotra; Arthur Y. Jones, both of Mississauga, Canada

[73] Assignee: Xerox Corporation, Stamford, Conn.

[21] Appl. No.: 432,448

[22] Filed: May 1, 1995

[51] Int. Cl.[6] ..... G03G 13/00

[52] U.S. Cl. ..... 427/145; 427/160; 427/412.1; 430/41

[58] Field of Search ..... 430/41; 427/145, 427/160, 412.1

[56] References Cited

U.S. PATENT DOCUMENTS

| | | | |
|---|---|---|---|
| 3,901,699 | 8/1975 | Sankus, Jr. . | |
| 3,909,262 | 9/1975 | Goffe et al. | 96/1.5 |
| 3,975,195 | 8/1976 | Goffe | 427/145 |
| 4,007,042 | 2/1977 | Buckley et al. | 96/1 PS |
| 4,021,110 | 5/1977 | Pundsack | 355/10 |
| 4,496,642 | 1/1985 | Tam et al. | 430/402 |
| 4,536,457 | 8/1985 | Tam | 430/41 |
| 4,536,458 | 8/1985 | Ng | 430/41 |
| 4,853,307 | 8/1989 | Tam et al. | 430/41 |
| 5,021,318 | 6/1991 | Mayo et al. | 430/124 |
| 5,102,756 | 4/1992 | Vincett et al. | 430/41 |
| 5,215,838 | 6/1993 | Tam et al. | 430/41 |

*Primary Examiner*—Erma Cameron
*Attorney, Agent, or Firm*—Judith L. Byorick

[57] ABSTRACT

Disclosed is a migration imaging member comprising (1) a substrate, (2) a softenable layer situated on the substrate, said softenable layer comprising a softenable material and a photosensitive migration marking material, and (3) an overcoating layer situated on the surface of the softenable layer spaced from the substrate, said overcoating layer comprising a material selected from the group consisting of: (a) polyacrylic acids, (b) poly (hydroxyalkyl methacrylates), (c) poly (hydroxyalkylacrylates), (d) vinyl alcohol-vinyl acetate copolymers, (e) vinyl alcohol-vinyl butyral copolymers, (f) alkyl celluloses, (g) aryl celluloses, (h) hydroxyalkyl cellulose acrylates, (i) hydroxyaryl cellulose acrylates, (j) hydroxyalkyl cellulose methacrylates, (k) hydroxyaryl cellulose methacrylates, (l) cellulose-acrylamide adducts, (m) poly (vinyl butyrals), (n) cyanoethylated celluloses, (o) cellulose acetate hydrogen phthalates, (p) hydroxypropylmethyl cellulose phthalates, (q) hydroxypropyl methyl cellulose succinates, (r) cellulose triacetates, (s) vinyl pyrrolidone-vinyl acetate copolymers, (t) vinyl chloride-vinylacetate-vinyl alcohol terpolymers, (u) ethylene-maleic anhydride copolymers, (v) styrene-maleic anhydride copolymers, (w) styrene-allyl alcohol copolymers, (x) poly (4-vinylpyridines), (y) polyester latexes, (z) vinyl chloride latexes, (aa) ethylene-vinyl chloride copolymer emulsions, (bb) poly vinyl acetate homopolymer emulsions, (cc) carboxylated vinyl acetate emulsion resins, (dd) vinyl acetate copolymer latexes, (ee) ethylene-vinyl acetate copolymer emulsions, (ff) acrylic-vinyl acetate copolymer emulsions, (gg) vinyl acrylic terpolymer latexes, (hh) acrylic emulsion latexes, (ii) polystyrene latexes, (jj) styrene-butadiene latexes, (kk) butadiene-acrylonitrile latexes, (ll) butadiene-acrylonitrile-styrene terpolymer latexes, (mm) propylene-acrylic acid copolymers, (nn) propylene-ethylene-acrylic acid terpolymers, (oo) poly (vinyl methyl ketones), (pp) poly (trimethyl hexamethylene) terephthalamides, (qq) chlorinated polypropylenes, (rr) poly (hexamethylene sebacates), (ss) poly(ethylene succinates), (tt) poly (caprolactams), (uu) poly (hexamethylene adipamides), (w) poly (hexamethylene nonaneamides), (ww) poly (hexamethylene sebacamides), (xx) poly (hexamethylene dodecane diamides), (yy) poly (undecanoamides), (zz) poly (lauryllactams), (aaa) ethylene-methacrylic acid ionomers, and (bbb) mixtures thereof.

11 Claims, 1 Drawing Sheet

OVERCOATED MIGRATION IMAGING MEMBERS

The present invention is directed to migration imaging members. More specifically, the present invention is directed to migration imaging members with improved overcoating layers. One embodiment of the present invention is directed to a migration imaging member comprising (1) a substrate, (2) a softenable layer situated on the substrate, said softenable layer comprising a softenable material and a photosensitive migration marking material, and (3) an overcoating layer situated on the surface of the softenable layer spaced from the substrate, said overcoating layer comprising a material selected from the group consisting of: (a) polyacrylic acids, (b) poly (hydroxyalkyl methacrylates), (c) poly (hydroxyalkylacrylates), (d) vinyl alcohol-vinyl acetate copolymers, (e) vinyl alcohol-vinyl butyral copolymers, (f) alkyl celluloses, (g) aryl celluloses, (h) hydroxyalkyl cellulose acrylates, (i) hydroxyaryl cellulose acrylates, (j) hydroxyalkyl cellulose methacrylates, (k) hydroxyaryl cellulose methacrylates, (l) cellulose-acrylamide adducts, (m) poly (vinyl butyrals), (n) cyanoethylated celluloses, (o) cellulose acetate hydrogen phthalates, (p) hydroxypropylmethyl cellulose phthalates, (q) hydroxypropyl methyl cellulose succinates, (r) cellulose triacetates, (s) vinyl pyrrolidone-vinyl acetate copolymers, (t) vinyl chloride-vinylacetate-vinyl alcohol terpolymers, (u) ethylene-maleic anhydride copolymers, (v) styrene-maleic anhydride copolymers, (w) styrene-allyl alcohol copolymers, (x) poly (4-vinylpyridines), (y) polyester latexes, (z) vinyl chloride latexes, (aa) ethylene-vinyl chloride copolymer emulsions, (bb) poly vinyl acetate homopolymer emulsions, (cc) carboxylated vinyl acetate emulsion resins, (dd) vinyl acetate copolymer latexes, (ee) ethylene-vinyl acetate copolymer emulsions, (ff) acrylic-vinyl acetate copolymer emulsions, (gg) vinyl acrylic terpolymer latexes, (hh) acrylic emulsion latexes, (ii) polystyrene latexes, (jj) styrene-butadiene latexes, (kk) butadiene-acrylonitrile latexes, (ll) butadiene-acrylonitrile-styrene terpolymer latexes, (mm) propylene-acrylic acid copolymers, (nn) propylene-ethylene-acrylic acid terpolymers, (oo) poly (vinyl methyl ketones), (pp) poly (trimethyl hexamethylene) terephthalamides, (qq) chlorinated polypropylenes, (rr) poly (hexamethylene sebacates), (ss) poly(ethylene succinates), (tt) poly (caprolactams), (uu) poly (hexamethylene adipamides), (vv) poly (hexamethylene nonaneamides), (ww) poly (hexamethylene sebacamides), (xx) poly (hexamethylene dodecane diamides), (yy) poly (undecanoamides), (zz) poly (lauryllactams), (aaa) ethylene-methacrylic acid ionomers, and (bbb) mixtures thereof. Another embodiment of the present invention is directed to a process which comprises (a) providing a migration imaging member comprising (1) a substrate, and (2) a softenable layer situated on the substrate, said softenable layer comprising a softenable material and a photosensitive migration marking material; (b) applying to the surface of the softenable layer spaced from the substrate a composition comprising (1) a solvent selected from the group consisting of (A) methanol, (B) ethanol, (C) isopropanol, (D) n-propanol, (E) acetone, (F) water, and (G) mixtures thereof, and (2) an overcoating material selected from the group consisting of (A) polyacrylic acids, (B) poly (hydroxyalkyl methacrylates), (C) poly (hydroxyalkylacrylates), (D) vinyl alcohol-vinyl acetate copolymers, (E) vinyl alcohol-vinyl butyral copolymers, (F) alkyl celluloses, (G) aryl celluloses, (H) hydroxyalkyl cellulose acrylates, (I) hydroxyaryl cellulose acrylates, (J) hydroxyalkyl cellulose methacrylates, (K) hydroxyaryl cellulose methacrylates, (L) cellulose-acrylamide adducts, (M) poly (vinyl butyrals), (N) cyanoethylated celluloses, (O) cellulose acetate hydrogen phthalates, (P) hydroxypropylmethyl cellulose phthalates, (Q) hydroxypropyl methyl cellulose succinates, (R) cellulose triacetates, (S) vinyl pyrrolidone-vinyl acetate copolymers, (T) vinyl chloride-vinylacetate-vinyl alcohol terpolymers, (U) ethylene-maleic anhydride copolymers, (V) styrene-maleic anhydride copolymers, (W) styrene-allyl alcohol copolymers, (X) poly (4-vinylpyridines), (Y) polyester latexes, (Z) vinyl chloride latexes, (AA) ethylene-vinyl chloride copolymer emulsions, (BB) poly vinyl acetate homopolymer emulsions, (CC) carboxylated vinyl acetate emulsion resins, (DD) vinyl acetate copolymer latexes, (EE) ethylene-vinyl acetate copolymer emulsions, (FF) acrylic-vinyl acetate copolymer emulsions, (GG) vinyl acrylic terpolymer latexes, (HH) acrylic emulsion latexes, (II) polystyrene latexes, (JJ) styrene-butadiene latexes, (KK) butadiene-acrylonitrile latexes, (LL) butadiene-acrylonitrile-styrene terpolymer latexes, (MM) propylene-acrylic acid copolymers, (NN) propylene-ethylene-acrylic acid terpolymers, (OO) poly (vinyl methyl ketones), (PP) poly (trimethyl hexamethylene) terephthalamides, (QQ) chlorinated polypropylenes, (RR) poly (hexamethylene sebacates), (SS) poly(ethylene succinates), (TT) poly (caprolactams), (UU) poly (hexamethylene adipamides), (VV) poly (hexamethylene nonaneamides), (WW) poly (hexamethylene sebacamides), (XX) poly (hexamethylene dodecane diamides), (YY) poly (undecanoamides), (ZZ) poly (lauryllactams), (AAA) ethylene-methacrylic acid ionomers, and (BBB) mixtures thereof; and (c) allowing the solvent to evaporate, thereby forming a layer of the overcoating material on the softenable layer. Yet another embodiment of the present invention is directed to a process which comprises (a) providing a migration imaging member comprising (1) a substrate, and (2) a softenable layer situated on the substrate, said softenable layer comprising a softenable material and a photosensitive migration marking material; (b) applying to the surface of the softenable layer spaced from the substrate by a melt extrusion process an overcoating material selected from the group consisting of (1) propylene-acrylic acid copolymers, (2) propylene-ethylene-acrylic acid terpolymers, (3) poly (vinyl methyl ketones), (4) poly (trimethyl hexamethylene) terephthalamides, (5) chlorinated polypropylenes, (6) poly (hexamethylene sebacates), (7) poly(ethylene succinates), (8) poly (caprolactams), (9) poly (hexamethylene adipamides), (10) poly (hexamethylene nonaneamides), (11) poly (hexamethylene sebacamides), (12) poly (hexamethylene dodecane diamides), (13) poly (undecanoamides), (14) poly (lauryllactams), (15) ethylene-methacrylic acid ionomers, and (16) mixtures thereof.

Migration imaging systems capable of producing high quality images of high optical contrast density and high resolution have been developed. Such migration imaging systems are disclosed in, for example, U.S. Pat. Nos. 5,215,838, 5,202,206, 5,102,756, 5,021,308, 4,970,130, 4,937,163, 4,883,731, 4,880,715, 4,853,307, 4,536,458, 4,536,457, 4,496,642, 4,482,622, 4,281,050, 4,252,890, 4,241,156, 4,230,782, 4,157,259, 4,135,926, 4,123,283, 4,102,682, 4,101,321, 4,084,966, 4,081,273, 4,078,923, 4,072,517, 4,065,307, 4,062,680, 4,055,418, 4,040,826, 4,029,502, 4,028,101, 4,014,695, 4,013,462, 4,012,250, 4,009,028, 4,007,042, 3,998,635, 3,985,560, 3,982,939, 3,982,936, 3,979,210, 3,976,483, 3,975,739, 3,975,195, and 3,909,262, the disclosures of each of which are totally incorporated herein by reference, and in "Migration Imaging Mechanisms, Exploitation, and Future Prospects Of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosure of which is totally incorporated herein by reference.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured for the purpose of this invention by diffuse densitometers with a blue Wratten No. 94 filter. The expression "optical density" as used herein is intended to mean "transmission optical density" and is represented by the formula:

$$D=log_{10}[I_o/I]$$

where I is the transmitted light intensity and $I_o$ is the incident light intensity. For the purpose of this invention, all values of transmission optical density given in this invention include the substrate density of about 0.2 which is the typical density of a metallized polyester substrate.

High optical density in migration imaging members allows high contrast densities in migration images made from the migration imaging members. High contrast density is highly desirable for most information storage systems. Contrast density is used herein to denote the difference between maximum and minimum optical density in a migration image. The maximum optical density value of an imaged migration imaging member is, of course, the same value as the optical density of an unimaged migration imaging member.

There are various other systems for forming such images, wherein non-photosensitive or inert marking materials are arranged in the aforementioned fracturable layers, or dispersed throughout the softenable layer, as described in the aforementioned patents, which also disclose a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore, the image sense of the developed image is optically sign reversed. Various methods and materials and combinations thereof have previously been used to fix such unfixed migration images. One method is to overcoat the image with a transparent abrasion resistant polymer by solution coating techniques. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8 to 1.9. Therefore, the image sense of the heat or vapor developed images is optically sign-retained.

Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the postdevelopment overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded. Recently, improvements in migration imaging members and processes for forming images on these migration imaging members have been achieved. These improved migration imaging members and processes are described in U.S. Pat. No. 4,536,458 and U.S. Pat. No. 4,536,457.

U.S. Pat. No. 5,215,838 (Tam et al.), the disclosure of which is totally incorporated herein by reference, discloses a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light radiation sensitive pigment is sensitive contained at or near the surface of the softenable layer. When the migration imaging member is imaged and developed, it is particularly suitable for use as a xeroprinting master and can also be used for viewing or for storing data.

U.S. Pat. No. 5,021,318 (Mayo et al.), the disclosure of which is totally incorporated herein by reference, discloses a process for forming secure images which comprises electrostatically charging an imaging member, imagewise exposing the charged member, thereby forming a latent image on the member, developing the latent image with a liquid developer comprising a liquid medium, a charge control additive, and toner particles comprising a colorant and a polymeric material, allowing the developed image to dry on the imaging member, contacting the portion of the imaging member with the dry developed image with a substantially transparent sheet having an adhesive material on the surface thereof in contact with the imaging member, thereby transferring the developed image from the imaging member to the substantially transparent sheet, contacting the adhesive surface of the substantially transparent sheet with the developed image with a paper sheet having a polymeric coating on the surface that is in contact with the substantially transparent sheet, and applying heat and pressure to the substantially transparent sheet and the paper sheet at a temperature and pressure sufficient to affix the image permanently to the paper. The resulting document is a paper sheet covered with the transparent sheet, with the developer material that forms the image being situated between the paper sheet and the transparent sheet. The disclosed process is generally useful for applications such as passport photographs, identification badges, banknote paper, and the like.

U.S. Pat. No. 4,496,642 (Tam et al.), the disclosure of which is totally incorporated herein by reference, discloses an imaging member comprising a substrate, an electrically insulating swellable, softenable layer on the substrate, the softenable layer having particulate migration marking material located at least at or near the surface of the softenable layer spaced from the substrate, and a protective overcoating comprising a film forming resin, a portion of which extends beneath the surface of the softenable layer. This migration imaging member may be prepared with the aid of a material which swells at least the surface of the softenable layer to allow the film forming resin to penetrate beneath the surface of the softenable layer.

U.S. Pat. No. 4,021,110 (Pundsack), the disclosure of which is totally incorporated herein by reference, discloses a camera/processor for continuously exposing and developing photographic migration imaging film. The apparatus can perform either heat or meniscus development and, optionally, film overcoating. After the film is exposed, it travels along a predetermined path, which path may include a plurality of separate film developing and film drying stations, toward a takeup reel.

U.S. Pat. No. 4,007,042 (Buckley et al.), the disclosure of which is totally incorporated herein by reference, discloses a migration imaging system including imaging members comprising a substrate overcoated with a softenable layer, and migration marking material, with the softenable layer having a thin surface skin of material having a higher viscosity than the remainder of the softenable material layer.

U.S. Pat. No. 3,909,262 (Goffe et al.), the disclosure of which is totally incorporated herein by reference, discloses a migration imaging system wherein migration imaging members typically comprising a substrate, a layer of softenable material, and migration marking material, additionally contain one or more overlayers of material to produce improved results in the imaging system. The overlayer may variously comprise another layer of softenable material, a layer of material which is harder than the softenable material layer, or a gelatin layer.

Migration imaging members are also suitable for use as masks for exposing the photosensitive material in a printing plate. The migration imaging member can be laid on the plate prior to exposure to radiation, or the migration imaging member layers can be coated or laminated onto the printing plate itself prior to exposure to radiation, and removed subsequent to exposure.

U.S. Pat. No. 5,102,756 (Vincett et al.), the disclosure of which is totally incorporated herein by reference, discloses a printing plate precursor which comprises a base layer, a layer of photohardenable material, and a layer of softenable material containing photosensitive migration marking material. Alternatively, the precursor can comprise a base layer and a layer of softenable photohardenable material containing photosensitive migration marking material. Also disclosed are processes for preparing printing plates from the disclosed precursors.

Copending application U.S. Ser. No. 08/353,461, now U.S. Pat. No. 5,576,129 filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, and William W. Limburg, the disclosure of which is totally incorporated herein by reference, discloses a migration imaging member comprising a substrate, a first softenable layer comprising a first softenable material and a first migration marking material contained at or near the surface of the first softenable layer spaced from the substrate, and a second softenable layer comprising a second softenable material and a second migration marking material. Also disclosed is a migration imaging process employing the aforesaid imaging member.

Copending application U.S. Ser. No. 08/413,667, now U.S. Pat. No. 5,532,102, mailed Mar. 24, 1995, entitled "Improved Apparatus and Process for Preparation of Migration Imaging Members," with the named inventors Philip H. Soden and Arnold L. Pundsack, the disclosure of which is totally incorporated herein by reference, discloses an apparatus for evaporation of a vacuum evaporatable material onto a substrate, said apparatus comprising (a) a walled container for the vacuum evaporatable material having a plurality of apertures in a surface thereof, said apertures being configured so that the vacuum evaporatable material is uniformly deposited onto the substrate; and (b) a source of heat sufficient to effect evaporation of the vacuum evaporatable material from the container through the apertures onto the substrate, wherein the surface of the container having the plurality of apertures therein is maintained at a temperature equal to or greater than the temperature of the vacuum evaporatable material.

While known apparatus and processes are suitable for their intended purposes, a need remains for improved migration imaging members. In addition, a need remains for migration imaging members with improved scratch resistance and fingerprint resistance. Further, there is a need for migration imaging members with improved charge retention. Additionally, there is a need for migration imaging members that can be prepared at relatively rapid speeds. There is also a need for migration imaging members which can be prepared with overcoatings compatible with the softenable layer.

SUMMARY OF THE INVENTION

It is an object of the present invention to provide migration imaging members with the above noted advantages.

It is another object of the present invention to provide improved migration imaging members.

It is yet another object of the present invention to provide migration imaging members with improved scratch resistance and fingerprint resistance.

It is still another object of the present invention to provide migration imaging members with improved charge retention.

Another object of the present invention is to provide migration imaging members that can be prepared at relatively rapid speeds.

Yet another object of the present invention is to provide migration imaging members which can be prepared with overcoatings compatible with the softenable layer.

These and other objects of the present invention (or specific embodiments thereof) can be achieved by providing a migration imaging member comprising (1) a substrate, (2) a softenable layer situated on the substrate, said softenable layer comprising a softenable material and a photosensitive migration marking material, and (3) an overcoating layer situated on the surface of the softenable layer spaced from the substrate, said overcoating layer comprising a material selected from the group consisting of: (a) polyacrylic acids, (b) poly (hydroxyalkyl methacrylates), (c) poly (hydroxyalkylacrylates), (d) vinyl alcohol-vinyl acetate copolymers, (e) vinyl alcohol-vinyl butyral copolymers, (f) alkyl celluloses, (g) aryl celluloses, (h) hydroxyalkyl cellulose acrylates, (i) hydroxyaryl cellulose acrylates, (j) hydroxyalkyl cellulose methacrylates, (k) hydroxyaryl cellulose methacrylates, (l) cellulose-acrylamide adducts, (m) poly (vinyl butyrals), (n) cyanoethylated celluloses, (o) cellulose acetate hydrogen phthalates, (p) hydroxypropylmethyl cellulose phthalates, (q) hydroxypropyl methyl cellulose succinates, (r) cellulose triacetates, (s) vinyl pyrrolidone-vinyl acetate copolymers, (t) vinyl chloride-vinylacetate-vinyl alcohol terpolymers, (u) ethylene-maleic anhydride copolymers, (v) styrene-maleic anhydride copolymers, (w) styrene-allyl alcohol copolymers, (x) poly (4-vinylpyridines), (y) polyester latexes, (z) vinyl chloride latexes, (aa) ethylene-vinyl chloride copolymer emulsions, (bb) poly vinyl acetate homopolymer emulsions, (cc) carboxylated vinyl acetate emulsion resins, (dd) vinyl acetate copolymer latexes, (ee) ethylene-vinyl acetate copolymer emulsions, (ff) acrylic-vinyl acetate copolymer emulsions, (gg) vinyl acrylic terpolymer latexes, (hh) acrylic emulsion latexes, (ii) polystyrene latexes, (jj) styrene-butadiene latexes, (kk) butadiene-acrylonitrile latexes, (ll) butadiene-acrylonitrile-styrene terpolymer latexes, (mm) propylene-acrylic acid copolymers, (nn) propylene-ethylene-acrylic acid terpolymers, (oo) poly (vinyl methyl ketones), (pp) poly (trimethyl hexamethylene) terephthalamides, (qq) chlorinated polypropylenes, (rr) poly (hexamethylene sebacates), (ss) poly(ethylene succinates), (tt) poly (caprolactams), (uu) poly (hexamethylene adipamides), (vv) poly (hexamethylene nonaneamides), (ww) poly (hexamethylene sebacamides), (xx) poly (hexamethylene dodecane diamides), (yy) poly (undecanoamides), (zz) poly (lauryllactams), (aaa) ethylene-methacrylic acid ionomers, and (bbb) mixtures thereof. Another embodiment of the present invention is directed to a process which comprises (a) providing a migration imaging member comprising (1) a substrate, and (2) a softenable layer situated on the substrate, said softenable layer comprising a softenable material and a photosensitive migration marking material; (b) applying to the surface of the softenable layer spaced from the substrate a composition comprising (1) a solvent selected from the group consisting of (A) methanol, (B) ethanol, (C) isopropanol, (D) n-propanol, (E) acetone, (F) water, and (G) mixtures thereof, and (2) an overcoating material selected from the group consisting of (A) polyacrylic acids, (B) poly (hydroxyalkyl methacrylates), (C) poly (hydroxyalkylacrylates), (D) vinyl alcohol-vinyl acetate copolymers, (E) vinyl alcohol-vinyl butyral copolymers, (F) alkyl celluloses, (G) aryl celluloses, (H) hydroxyalkyl cellulose acrylates, (I) hydroxyaryl cellulose acrylates, (J) hydroxyalkyl cellulose methacrylates, (K) hydroxyaryl cellulose methacrylates, (L) cellulose-acrylamide adducts, (M) poly (vinyl butyrals), (N) cyanoethylated celluloses, (O) cellulose acetate hydrogen phthalates, (P) hydroxypropylmethyl cellulose phthalates, (Q) hydroxypropyl methyl cellulose succinates, (R) cellulose triacetates, (S) vinyl pyrrolidone-vinyl acetate copolymers, (T) vinyl chloride-vinylacetate-vinyl alcohol terpolymers, (U) ethylene-maleic anhydride copolymers, (V) styrene-maleic anhydride copolymers, (W) styrene-allyl alcohol copolymers, (X) poly (4-vinylpyridines), (Y) polyester latexes, (ZZ) vinyl chloride latexes, (AA) ethylene-vinyl chloride copolymer emulsions, (BB) poly vinyl acetate homopolymer emulsions, (CC) carboxylated vinyl acetate emulsion resins, (DD) vinyl acetate copolymer latexes, (EE) ethylene-vinyl acetate copolymer emulsions, (FF) acrylic-vinyl acetate copolymer emulsions, (GG) vinyl acrylic terpolymer latexes, (HH) acrylic emulsion latexes, (II) polystyrene latexes, (JJ) styrene-butadiene latexes, (KK) butadiene-acrylonitrile latexes, (LL) butadiene-acrylonitrile-styrene terpolymer latexes, (MM) propylene-acrylic acid copolymers, (NN) propylene-ethylene-acrylic acid terpolymers, (OO) poly (vinyl methyl ketones), (PP) poly (trimethyl hexamethylene) terephthalamides, (QQ) chlorinated polypropylenes, (RR) poly (hexamethylene sebacates), (SS) poly(ethylene succinates), (TT) poly (caprolactams), (UU) poly (hexamethylene adipamides), (VV) poly (hexamethylene nonaneamides), (WW) poly (hexamethylene sebacamides), (XX) poly (hexamethylene dodecane diamides), (YY) poly (undecanoamides), (ZZ) poly (lauryllactams), (AAA) ethylene-methacrylic acid ionomers, and (BBB) mixtures thereof; and (c) allowing the solvent to evaporate, thereby forming a layer of the overcoating material on the softenable layer. Yet another embodiment of the present invention is directed to a process which comprises (a) providing a migration imaging member comprising (1) a substrate, and (2) a softenable layer situated on the substrate, said softenable layer comprising a softenable material and a photosensitive migration marking material; (b) applying to the surface of the softenable layer spaced from the substrate by a melt extrusion process an overcoating material selected from the group consisting of (1) propylene-acrylic acid copolymers, (2) propylene-ethylene-acrylic acid terpolymers, (3) poly (vinyl methyl ketones), (4) poly (trimethyl hexamethylene) terephthalamides, (5) chlorinated polypropylenes, (6) poly (hexamethylene sebacates), (7) poly(ethylene succinates), (8) poly (caprolactams), (9) poly (hexamethylene adipamides), (10) poly (hexamethylene nonaneamides), (11) poly (hexamethylene sebacamides), (12) poly (hexamethylene dodecane diamides), (13) poly (undecanoamides), (14) poly (lauryllactams), (15) ethylene-methacrylic acid ionomers, and (16) mixtures thereof.

DETAILED DESCRIPTION OF THE INVENTION

The present invention encompasses a migration imaging member having a substrate, a softenable layer containing migration marking material, and an overcoating layer.

Figure 1:
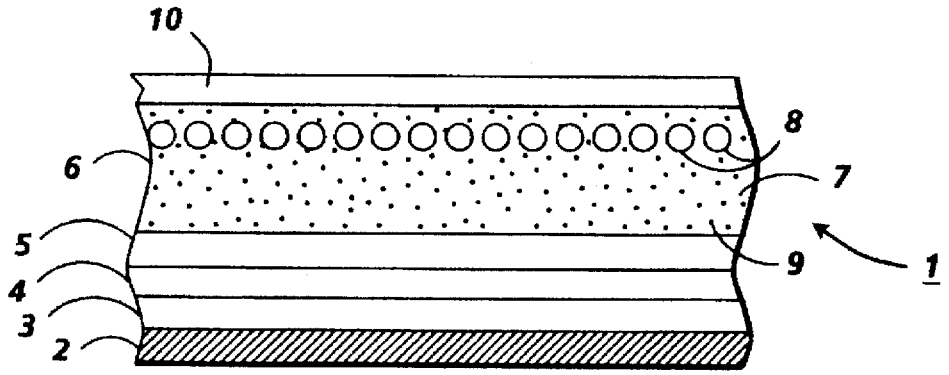
FIG. 1 illustrates schematically one migration imaging member suitable for the present invention.

An example of a migration imaging member suitable for the present invention is illustrated schematically in FIG. 1. As illustrated schematically in FIG. 1, migration imaging member 1 comprises a substrate 2, an optional adhesive layer 3 situated on the substrate 2, an optional charge blocking layer 4 situated on optional adhesive layer 3, an optional charge transport layer 5 situated on optional charge blocking layer 4, and a softenable layer 6 situated on optional charge transport layer 5, said softenable layer 6 comprising softenable material 7, migration marking material 8 situated at or near the surface of the layer spaced from the substrate, and optional charge transport material 9 dispersed throughout softenable material 7. Overcoating layer 10 is situated on the surface of softenable layer 6 spaced from the substrate 2. Any or all of the optional layers and materials can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate can be either electrically conductive or electrically insulating. When conductive, the substrate can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. When insulative, the substrate can be opaque, translucent, semitransparent, or transparent, and can be of any suitable insulative material, such as paper, glass, plastic, polyesters such as Mylar® (available from Du Pont) or Melinex® 442 (available from ICI Americas, Inc.), and the like. In addition, the substrate can comprise an insulative layer with a conductive coating, such as vacuum-deposited metallized plastic, such as titanized or aluminized Mylar® polyester, wherein the metallized surface is in contact with the softenable layer or any other layer situated between the substrate and the softenable layer. The substrate has any effective thickness, typically from about 6 to about 250 microns, and preferably from about 50 to about 200 microns, although the thickness can be outside these ranges.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrene-vinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, typically from about 1 to about 30 microns, preferably from about 2 to about 25 microns, and more preferably from about 2 to about 10 microns, although the thickness can be outside these ranges. The softenable layer can be applied to the conductive layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or of any other suitable combination of materials, or possess any other desired physical property and still be suitable for use in the migration imaging members of the present invention. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the conductive layer. When present as particles, the particles of migration marking material preferably have an average diameter of up to 2 microns, and more preferably of from about 0.1 to about 1 micron. The layer of migration marking particles is situated at or near that surface of the softenable layer spaced from or most distant from the conductive layer. Preferably, the particles are situated at a distance of from about 0.01 to 0.1 micron from the layer surface, and more preferably from about 0.02 to 0.08 micron from the layer surface. Preferably, the particles are situated at a distance of from about 0.005 to about 0.2 micron from each other, and more preferably at a distance of from about 0.05 to about 0.1 micron from each other, the distance being measured between the closest edges of the particles, i.e. from outer diameter to outer diameter. The migration marking material contiguous to the outer surface of the softenable layer is present in any effective amount, preferably from about 5 to about 80 percent by total weight of the softenable layer, and more preferably from about 25 to about 80 percent by total weight of the softenable layer, although the amount can be outside of this range.

Examples of suitable migration marking materials include selenium, alloys of selenium with alloying components such as tellurium, arsenic, antimony, thallium, bismuth, or mixtures thereof, selenium and alloys of selenium doped with halogens, as disclosed in, for example, U.S. Pat. No. 3,312,548, the disclosure of which is totally incorporated herein by reference, and the like, phthalocyanines, and any other suitable materials as disclosed, for example, in U.S. Pat. No. 3,975,195 and other U.S. patents directed to migration imaging members and incorporated herein by reference.

If desired, two or more softenable layers, each containing migration marking particles, can be present in the imaging member as disclosed in copending application U.S. Ser. No. 08/353,461, now U.S. Pat. No. 5,576,129, filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, and William W. Limburg, the disclosure of which is totally incorporated herein by reference.

The migration imaging members can optionally contain a charge transport material. The charge transport material can be any suitable charge transport material either capable of acting as a softenable layer material or capable of being dissolved or dispersed on a molecular scale in the softenable layer material. When a charge transport material is also contained in another layer in the imaging member, preferably there is continuous transport of charge through the entire film structure. The charge transport material is defined as a material which is capable of improving the charge injection process for one sign of charge from the migration marking material into the softenable layer and also of transporting that charge through the softenable layer. The charge transport material can be either a hole transport material (transports positive charges) or an electron transport material (transports negative charges). The sign of the charge used to sensitize the migration imaging member during imaging can be of either polarity. Charge transporting materials are well known in the art. Typical charge transporting materials include the following:

Diamine transport molecules of the type described in U.S. Pat. No. 4,306,008, U.S. Pat. No. 4,304,829, U.S. Pat. No. 4,233,384, U.S. Pat. No. 4,115,116, U.S. Pat. No. 4,299,897, and U.S. Pat. No. 4,081,274, the disclosures of each of which are totally incorporated herein by reference. Typical diamine transport molecules include N,N'-diphenyl-N,N'-bis(3"-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851, the disclosures of each of which are totally incorporated herein by reference. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl) pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene,2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836, German Patent 1,060,260, and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example in U.S. Pat. No. 4,150,987, U.S. Pat. No. 4,385,106, U.S. Pat. No. 4,338,388, and U.S. Pat. No. 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. No. 4,256,821 and U.S. Pat. No. 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)-oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989, the disclosure of which is totally incorporated herein by reference.

9-Fluorenylidene methane derivatives having the formula

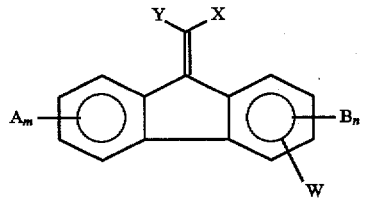

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene) malonontrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toluene, 4,6-dichloro-1,3-dinitrobenzene, 4,6-dibromo-1,3-dinitrobenzene, P-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

Also suitable are charge transport materials such as triarylamines, including tritolyl amine, of the formula

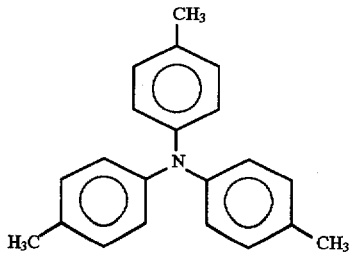

and the like, as disclosed in, for example, U.S. Pat. No. 3,240,597 and U.S. Pat. No. 3,180,730, the disclosures of which are totally incorporated herein by reference, and substituted diarylmethane and triarylmethane compounds, including bis-(4-diethylamino-2-methylphenyl) phenylmethane, of the formula

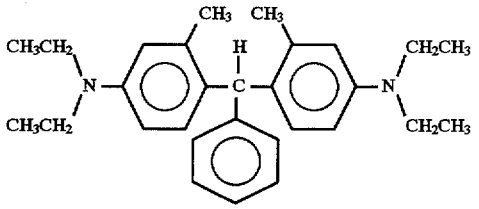

and the like, as disclosed in, for example, U.S. Pat. No. 4,082,551, U.S. Pat. No. 3,755,310, U.S. Pat. No. 3,647,431, British Patent 984,965, British Patent 980,879, and British Patent 1,141,666, the disclosures of which are totally incorporated herein by reference.

When the charge transport molecules are combined with an insulating binder to form the softenable layer, the amount of charge transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

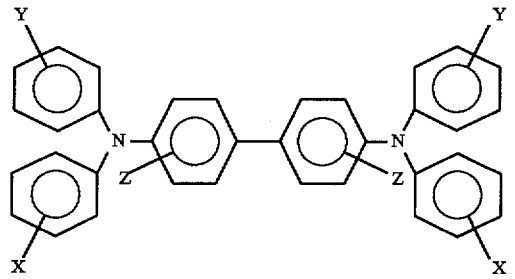

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. results can be obtained when the softenable layer contains between about 8 percent to about 40 percent by weight of these diamine compounds based on the total weight of the softenable layer. Optimum results are achieved when the softenable layer contains between about 16 percent to about 32 percent by weight of N,N'-diphenyl-N,N'-bis(3"-methylphenyl)-(1,1'-biphenyl)-4,4'-diamine based on the total weight of the softenable layer.

The charge transport material is present in the softenable material in any effective amount, typically from about 5 to about 50 percent by weight and preferably from about 8 to about 40 percent by weight, although the amount can be outside these ranges. Alternatively, the softenable layer can employ the charge transport material as the softenable material if the charge transport material possesses the necessary film-forming characteristics and otherwise functions as a softenable material. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, and the like.

The optional adhesive layer can include any suitable adhesive material. Typical adhesive materials include copolymers of styrene and an acrylate, polyester resin such as DUPONT 49000® (available from E. I. duPont de Nemours Company), copolymer of acrylonitrile and vinylidene chloride, polyvinyl acetate, polyvinyl butyral and the like and mixtures thereof. The adhesive layer can have any thickness, typically from about 0.05 to about 1 micron, although the thickness can be outside of this range. When an adhesive layer is employed, it preferably forms a uniform and continuous layer having a thickness of about 0.5 micron or less to ensure satisfactory discharge during the imaging process. It can also optionally include charge transport molecules.

The optional charge transport layer can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm; other copolymers of styrene and hexylmethacrylate, styrene-vinyltoluene copolymers, polyalpha-methylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the imaging process. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a conductive layer. Alternatively, a uniform deposit of electrostatic charge of suitable polarity on the exposed surface of the charge transport spacing layer can be substituted for a conductive layer to facilitate the application of electrical migration forces to the migration layer. This technique of "double charging" is well known in the art. The charge transport layer is of any effective thickness, typically from about 1 to about 25 microns, and preferably from about 2 to about 20 microns, although the thickness can be outside these ranges.

Charge transport molecules suitable for the charge transport layer are described in detail hereinabove. The specific charge transport molecule utilized in the charge transport layer of any given imaging member can be identical to or different from the charge transport molecule employed in the adjacent softenable layer. Similarly, the concentration of the charge transport molecule utilized in the charge transport spacing layer of any given imaging member can be identical to or different from the concentration of charge transport molecule employed in the adjacent softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside this range. The charge transport material can be incorporated into the charge transport layer by techniques similar to those employed for the softenable layer.

The optional charge blocking layer can be of various suitable materials, provided that the objectives of the present invention are achieved, including aluminum oxide, polyvinyl butyral, silane and the like, as well as mixtures thereof. This layer, which is generally applied by known coating techniques, is of any effective thickness, typically from about 0.05 to about 0.5 micron, and preferably from about 0.05 to about 0.1 micron. Typical coating processes include draw bar coating, spray coating, extrusion, dip coating, gravure roll coating, wire-wound rod coating, air knife coating and the like.

Figure 2:
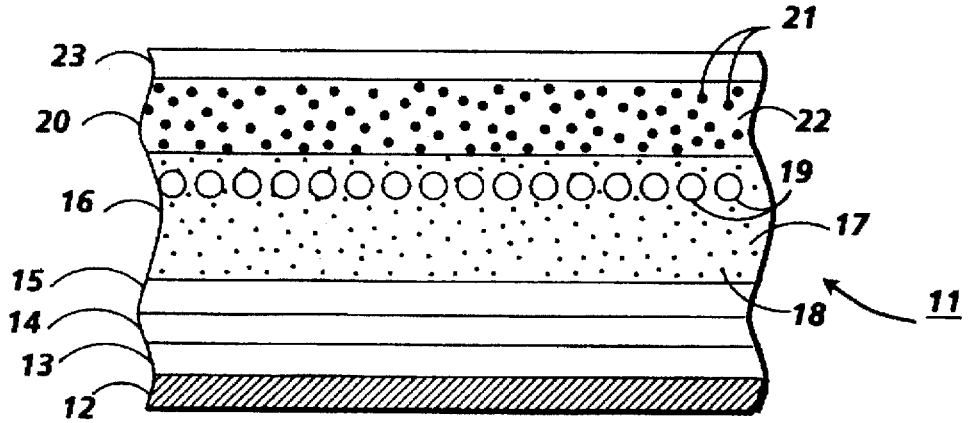
FIG. 2 illustrates schematically an infrared or red-light sensitive migration imaging member suitable for the present invention.

As illustrated schematically in FIG. 2, migration imaging member 11 comprises in the order shown a substrate 12, an optional adhesive layer 13 situated on substrate 12, an optional charge blocking layer 14 situated on optional adhesive layer 13, an optional charge transport layer 15 situated on optional charge blocking layer 14, a softenable layer 16 situated on optional charge transport layer 15, said softenable layer 16 comprising softenable material 17, charge transport material 18, and migration marking material 19 situated at or near the surface of the layer spaced from the substrate, and an infrared or red light radiation sensitive layer 20 situated on softenable layer 16 comprising infrared or red light radiation sensitive pigment particles 21 optionally dispersed in polymeric binder 22. Alternatively (not shown), infrared or red light radiation sensitive layer 20 can comprise infrared or red light radiation sensitive pigment particles 21 directly deposited as a layer by, for example, vacuum evaporation techniques or other coating methods. Overcoating layer 23 is situated on the surface of imaging member 11 spaced from the substrate 12.

Figure 3:
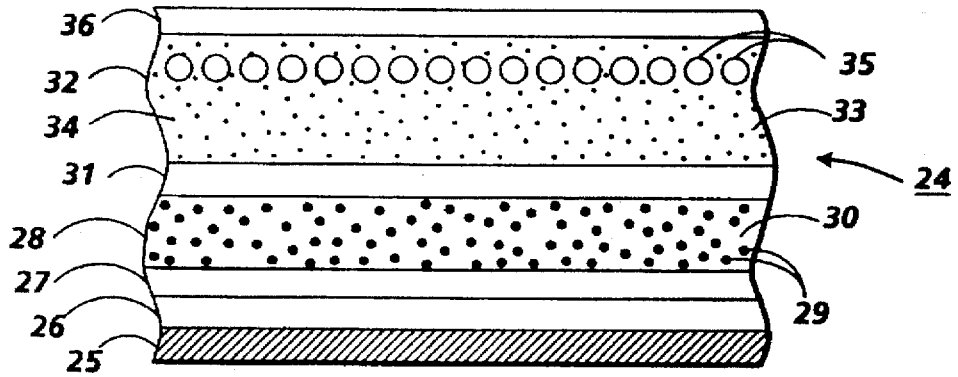
FIG. 3 illustrates schematically another infrared or red-light sensitive migration imaging member suitable for the present invention.

As illustrated schematically in FIG. 3, migration imaging member 24 comprises in the order shown a substrate 25, an optional adhesive layer 26 situated on substrate 25, an optional charge blocking layer 27 situated on optional adhesive layer 26, an infrared or red light radiation sensitive layer 28 situated on optional charge blocking layer 27 comprising infrared or red light radiation sensitive pigment particles 29 optionally dispersed in polymeric binder 30, an optional charge transport layer 31 situated on infrared or red light radiation sensitive layer 28, and a softenable layer 32 situated on optional charge transport layer 31, said softenable layer 32 comprising softenable material 33, charge transport material 34, and migration marking material 35 situated at or near the surface of the layer spaced from the substrate. Overcoating layer 36 is situated on the surface of imaging member 24 spaced from the substrate 25.

The infrared or red light sensitive layer generally comprises a pigment sensitive to infrared and/or red light radiation. While the infrared or red light sensitive pigment may exhibit some photosensitivity in the wavelength to which the migration marking material is sensitive, it is preferred that photosensitivity in this wavelength range be minimized so that the migration marking material and the infrared or red light sensitive pigment exhibit absorption peaks in distinct, different wavelength regions. This pigment can be deposited as the sole or major component of the infrared or red light sensitive layer by any suitable technique, such as vacuum evaporation or the like. An infrared or red light sensitive layer of this type can be formed by placing the pigment and the imaging member comprising the substrate and any previously coated layers into an evacuated chamber, followed by heating the infrared or red light sensitive pigment to the point of sublimation. The sublimed material recondenses to form a solid film on the imaging member. Alternatively, the infrared or red light sensitive pigment can be dispersed in a polymeric binder and the dispersion coated onto the imaging member to form a layer. Examples of suitable red light sensitive pigments include perylene pigments such as benzimidazole perylene, dibromoanthranthrone, crystalline trigonal selenium, beta-metal free phthalocyanine, azo pigments, and the like, as well as mixtures thereof. Examples of suitable infrared sensitive pigments include X-metal free phthalocyanine, metal phthalocyanines such as vanadyl phthalocyanine, chloroindium phthalocyanine, titanyl phthalocyanine, chloroaluminum phthalocyanine, copper phthalocyanine, magnesium phthalocyanine, and the like, squaraines, such as hydroxy squaraine, and the like as well as mixtures thereof. Examples of suitable optional polymeric binder materials include polystyrene, styrene-acrylic copolymers, such as styrene-hexylmethacrylate copolymers, styrene-vinyl toluene copolymers, polyesters, such as PE-200®, available from Goodyear, polyurethanes, polyvinylcarbazoles, epoxy resins, phenoxy resins, polyamide resins, polycarbonates, polyterpenes, silicone elastomers, polyvinylalcohols, such as GELVATOL® 20-90, 9000, 20-60, 6000, 20-30, 3000, 40-20, 40-10, 26-90, and 30-30, available from Monsanto Plastics and Resins Co., St. Louis, Mo., polyvinylformals, such as FORMVAR® 12/85, 5/95E, 6/95E, 7/95E, and 15/95E, available from Monsanto Plastics and Resins Co., St. Louis, Mo., polyvinylbutyrals, such as BUTVAR® B-72, B-74, B-73, B-76, B-79, B-90, and B-98, available from Monsanto Plastics and Resins Co., St. Louis, Mo., Zeneca resin A622, available from Zeneca Colours, Wilmington, Del., and the like as well as mixtures thereof. When the infrared or red light sensitive layer comprises both a polymeric binder and the pigment, the layer typically comprises the binder in an amount of from about 5 to about 95 percent by weight and the pigment in an amount of from about 5 to about 95 percent by weight, although the relative amounts can be outside this range. Preferably, the infrared or red light sensitive layer comprises the binder in an amount of from about 40 to about 90 percent by weight and the pigment in an amount of from about 10 to about 60 percent by weight. Optionally, the infrared sensitive layer can contain a charge transport material as described herein when a binder is present; when present, the charge transport material is generally contained in this layer in an amount of from about 5 to about 30 percent by weight of the layer. The optional charge transport material can be incorporated into the infrared or red light radiation sensitive layer by any suitable technique. For example, it can be mixed with the infrared or red light radiation sensitive layer components by dissolution in a common solvent. If desired, a mixture of solvents for the charge transport material and the infrared or red light sensitive layer material can be employed to facilitate mixing and coating. The infrared or red light radiation sensitive layer mixture can be applied to the substrate by any conventional coating process. Typical coating processes include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. When the infrared or red light sensitive layer is coated directly onto the softenable layer containing migration marking material, preferably the selected solvent is capable of dissolving the polymeric binder for the infrared or red sensitive layer but does not dissolve the softenable polymer in the layer containing the migration marking material. One example of a suitable solvent is isobutanol with a polyvinyl butyral binder in the infrared or red sensitive layer and a styrene/ethyl acrylate/acrylic acid terpolymer softenable material in the layer containing migration marking material. The infrared or red light sensitive layer can be of any effective thickness. Typical thicknesses for infrared or red light sensitive layers comprising a pigment and a binder are from about 0.05 to about 2 microns, and preferably from about 0.1 to about 1.5 microns, although the thickness can be outside these ranges. Typical thicknesses for infrared or red light sensitive layers consisting of a vacuum-deposited layer of pigment are from about 200 to about 2,000 Angstroms, and preferably from about 300 to about 1,000 Angstroms, although the thickness can be outside these ranges.

The overcoating layer can be substantially electrically insulating, or have any other suitable properties. The overcoating preferably is substantially transparent, at least in the spectral region where electromagnetic radiation is used for imagewise exposure step in the imaging process. The overcoating layer is continuous and preferably of a thickness up to about 1 to 2 microns. More preferably, the overcoating has a thickness of between about 0.1 and about 0.5 micron to minimize residual charge buildup. Overcoating layers greater than about 1 to 2 microns thick can also be used.

The overcoating layer is applied by a solvent coating method or a melt extrusion method. In the solvent coating method, the overcoating material is dissolved or dispersed in a solvent selected from the group consisting of methanol, ethanol, n-propanol, isopropanol, acetone, water, and mixtures thereof, followed by coating the solution or dispersion onto the imaging member. In the melt extrusion method, the polymer is melted and applied via extrusion die directly onto the imaging member. Examples of suitable overcoating materials include polyacrylic acid, such as #598, #599, #600, #413, available from Scientific Polymer Products, poly (hydroxyalkyl methacrylates), wherein alkyl has from 1 to about 18 carbon atoms, including methyl, ethyl, propyl, butyl, hexadecyl, and the like, including poly(2-hydroxyethylmethacrylate), such as #414, #815, available from Scientific Polymer Products, and poly (hydroxypropylmethacrylate), such as #232 available from Scientific Polymer Products, poly (hydroxyalkylacrylates), wherein alkyl is methyl, ethyl, or propyl, including poly(2-hydroxyethyl acrylate), such as #850, available from Scientific Polymer Products, and poly(hydroxypropyl acrylate), such as #851, available from Scientific Polymer Products, vinyl alcohol-vinyl acetate copolymers, including those with a vinyl alcohol content of about 9 percent by weight, such as #379, available from Scientific Polymer Products, vinyl alcohol-vinyl butyral copolymers, including those with a vinyl alcohol content of about 19.5 percent by weight, such as #381, available from Scientific Polymer Products, alkyl cellulose or aryl cellulose, wherein alkyl is methyl, ethyl, propyl, or butyl and aryl is phenyl or the like, including ethyl cellulose such as ETHOCEL® N-22, available from Hercules Chemical Company, and the like; ketone soluble polymers, such as those polymers soluble in acetone, including hydroxyalkyl cellulose acrylates and hydroxyaryl cellulose acrylates, wherein alkyl is methyl, ethyl, propyl, or butyl and aryl is phenyl or the like, including hydroxyethyl cellulose acrylate, such as #8630, available from Monomer-Polymer and Dajac Laboratories Inc., hydroxyalkyl cellulose methacrylates and hydroxyaryl cellulose methacrylates, wherein alkyl is methyl, ethyl, propyl, or butyl and aryl is phenyl or the like, including hydroxyethyl cellulose methacrylate, such as #8631, available from Monomer-Polymer and Dajac Laboratories Inc., cellulose-acrylamide adducts, such as #8959, #8960, #8961, #8962, available from Monomer-Polymer and Dajac Laboratories, Inc., poly (vinyl butyral), such as #043, #511, #507, available from Scientific Polymer Products, cyanoethylated cellulose, such as #091, available from Scientific Polymer Products, cellulose acetate hydrogen phthalate, such as #085, available from Scientific Polymer Products, hydroxypropylmethyl cellulose phthalate, such as HPMCP, available from Shin-Etsu Chemical, hydroxypropyl methyl cellulose succinate, such as HPMCS, available from Shin-Etsu Chemical, cellulose triacetate, such as #031, available from Scientific Polymer Products, poly (α-methylstyrene), such as #309, available from Scientific Polymer Products, vinyl pyrrolidone-vinyl acetate copolymers, such as #368 available from Scientific Polymer Products, vinyl chloride-vinylacetate-vinyl alcohol terpolymers, such as #428, available from Scientific Polymer Products, ethylene-maleic anhydride copolymers, such as #2308, available from Polysciences, Inc., also available as EMA from Monsanto Chemical Co., styrene-maleic anhydride copolymers such as #458, available from Scientific Polymer Products, styrene-allyl alcohol copolymers such as #393, available from Scientific Polymer Products, poly(4-vinylpyridine) such as #700, available from Scientific Polymer Products, and the like, as well as blends or mixtures of any of the above.

Suitable overcoating materials also include polymer latices. The polymer capable of forming a latex is, for the purposes of the present invention, a polymer that forms in water or in an organic solvent a stable colloidal system in which the disperse phase is polymeric. Examples of suitable latex-forming polymers include polyester latex such as Eastman AQ 29D available from Eastman Chemical Company, vinyl chloride latex, such as GEON® 352 from B. F. Goodrich Chemical Group, ethylene-vinyl chloride copolymer emulsions, such as AIRFLEX® ethylene-vinyl chloride from Air Products and Chemicals, poly vinyl acetate homopolymer emulsions, such as VINAC from Air Products and Chemicals, carboxylated vinyl acetate emulsion resins, such as SYNTHEMUL® synthetic resin emulsions 40-502, 40-503, and 97-664 from Reichhold Chemicals Inc. and POLYCO® 2149, 2150, and 2171, from Rohm and Haas Co., vinyl acetate copolymer latex, such as 76 RES 7800 from Union Oil Chemicals Divisions and RESYN 25-1103®, RESYN 25-1109®, RESYN 25-1119®, and RESYN 25-1189® from National Starch and Chemical Corporation, ethylene-vinyl acetate copolymer emulsions, such as AIRFLEX® ethylene-vinylacetate from Air Products and Chemicals Inc., acrylic-vinyl acetate copolymer emulsions, such as RHOPLEX® AR-74 from Rohm and Haas Co, SYNTHEMUL® 97-726 from Reichhold Chemicals Inc., RESYN® 25-1140, 25-1141, 25-1142, and RESYN-6820® from National Starch and Chemical Corporation, vinyl acrylic terpolymer latex, such as 76 RES 3103 from Union Oil Chemical Division and RESYN 25-1110® from National Starch and Chemical Corporation, acrylic emulsion latex, such as RHOPLEX B-15J®, RHOPLEX P-376®, RHOPLEX TR-407®, RHOPLEX E-940®, RHOPLEX TR-934®, RHOPLEX TR-520®, RHOPLEX HA-24®, and RHOPLEX NW-1825® from Rohm and Haas Company and HYCAR 2600 X 322®, HYCAR 2671®, HYCAR 2679®, HYCAR 26120®, and HYCAR 2600 X347® from B. F. Goodrich Chemical Group, polystyrene latex, such as DL6622A, DL6688A, and DL6687A from Dow Chemical Company, styrene-butadiene latexes, such as 76 RES 4100 and 76 RES 8100 available from Union Oil Chemicals Division, TYLAC® resin emulsion 68-412, TYLAC® resin emulsion 68-067, 68-319, 68-413, 68-500, 68-501, available from Reichhold Chemical Inc., and DL6672A, DL6663A, DL6638A, DL6626A, DL6620A, DL615A, DL617A, DL620A, DL640A, DL650A from Dow Chemical Company, butadiene-acrylonitrile latex, such as HYCAR 1561® and HYCAR 1562® from B. F. Goodrich Chemical Group and TYLAC® Synthetic Rubber Latex 68-302 from Reichhold Chemicals Inc., butadiene-acrylonitrile-styrene terpolymer latex, such as TYLAC® synthetic rubber latex 68-513 from Reichhold Chemicals Inc., and the like, as well as mixtures thereof.

Examples of melt extrudable polymers suitable as binder polymers for the first coating layer include (a) propylene-acrylic acid copolymers, such as those with a propylene content of 94 percent by weight (#585, available from Scientific Polymer Products); (b) propylene-ethylene-acrylic acid terpolymers, such as those with a propylene content of 75 percent by weight, ethylene content of 19 percent by weight, and acrylic acid content of 6 percent by weight (#586, available from Scientific Polymer Products); (c) poly (vinyl methyl ketone) (#280 Scientific Polymer Products); (d) poly (trimethyl hexamethylene) terephthalamide [Nylon 6(3)T] (#331, available from Scientific Polymer Products); (e) chlorinated polypropylene isotactic, chlorine content from about 26 percent by weight (#642) to about 65 percent by weight (#117), available from Scientific Polymer Products); (f) poly (hexamethylene sebacate) (#124, available from Scientific Polymer Products); (g) poly(ethylene succinate) (#150, available from Scientific Polymer Products); (h) polyamide resin (#385, #386, #387, #388, #389, #390, available from Scientific Polymer Products); (i) Nylon 6 [poly (caprolactam)] (#034, available from Scientific Polymer Products); (j) Nylon 6/6 [poly (hexamethylene adipamide)] (#033, available from Scientific Polymer Products); (k) Nylon 6/9 [poly (hexamethylene nonaneamide)] (#156, available from Scientific Polymer Products); (l) Nylon 6/10 [poly (hexamethylene sebacamide)] (#139, available from Scientific Polymer Products); (m) Nylon 6/12 [poly (hexamethylene dodecane diamide)] (#313, available from Scientific Polymer Products); (n) Nylon 11 [poly (undecanoamide)] (#006, available from Scientific Polymer Products); (o) Nylon 12 [poly (lauryllactam)] (#44, available from Scientific Polymer Products); (p) ethylene-methacrylic acid ionomers, sodium ion (#465, #466, #467, #468) and ethylene-methacrylic acid ionomers zinc ion (#469, #470, #471, #472), available from Scientific Polymer Products); and the like, as well as blends or mixtures of any of the above.

Any mixtures of the above overcoating materials in any relative amounts can be employed.

The overcoating layer is generally applied by known coating techniques, including (but not limited to) draw bar coating, spray coating, extrusion, dip coating, gravure roll coating, wire-wound rod coating, air knife coating and the like.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Migration imaging members were prepared as follows. A solution for an adhesive layer was prepared by dissolving about 2.3 parts by weight of a polyester resin (DU PONT 49K® obtained from E. I. Du Pont de Nemours & Co., Wilmington, Del.) in about 97.7 parts by weight of a solvent containing 70 percent by weight tetrahydrofuran and 30 percent by weight cyclohexanone. The resulting solution was coated by a solvent extrusion technique onto 4 mil thick polyester substrates (MELINEX 442®, obtained from Imperial Chemical Industries (ICI), aluminized to 50 percent light transmission), and the deposited adhesive layers were allowed to dry at about 60° C. for about 2 minutes, resulting in dried adhesive layers with thicknesses of about 500 Angstroms.

A solution for a charge blocking layer was then prepared by dissolving about 3 parts by weight of a silane (A-1100, obtained from Union Carbide, Montreal, Canada) in about 97 parts by weight of a solvent containing 71 percent by weight ethanol, 21 percent by weight heptane, 1 percent by weight acetic acid, and 7 percent by weight water. The resulting solution was coated by a solvent extrusion technique onto the adhesive layers of the imaging members and the deposited charge blocking layers were allowed to dry at about 60° C. for about 2 minutes, resulting in dried adhesive layers with thicknesses of about 500 Angstroms.

A solution for the softenable layer was then prepared by dissolving about 15 parts by weight of a terpolymer of styrene/ethylacrylate/acrylic acid (prepared as disclosed in U.S. Pat. No. 4,853,307, the disclosure of which is totally incorporated herein by reference) in about 85 parts by weight of toluene. The resulting solution was coated by a solvent extrusion technique onto the charge blocking layers, and the deposited softenable layers were allowed to dry at about 115° C. for about 2 minutes, resulting in dried softenable layers with thicknesses of about 2.0 microns. The temperature of the softenable layers was then raised to about 115° C. to lower the viscosity of the exposed surfaces of the softenable layers to about $5\times10^3$ poises in preparation for the deposition of marking material. Thin layers of particulate vitreous selenium were then applied by vacuum deposition in a vacuum chamber maintained at a vacuum of about $4\times10^{-4}$ Torr. The imaging members were then rapidly chilled to room temperature. Reddish monolayers of selenium particles having an average diameter of about 0.3 micron embedded about 0.05 to 0.1 micron below the surfaces of the copolymer layers were formed.

Thereafter, a solution for one overcoating layer was prepared by dissolving about 5 parts by weight of hydroxypropylmethylcellulose phthalate (HPmcp HP-50, obtained from Shin-Etsu Chemical Co., Ltd., Tokyo, Japan) in about 95 parts by weight of a solvent containing 80 percent by weight ethanol and 20 percent by weight water. The resulting solution was coated by a solvent extrusion technique onto the softenable layer of one of the imaging members, and the deposited overcoating layer was allowed to dry at about 115° C. for about 2 minutes, resulting in a dried overcoating layer with a thickness of about 3 or 4 microns. The overcoating process was repeated with different overcoating compositions and solvents as indicated in the table below. The imaging members thus formed were fingerprint and scratch resistant.

The migration imaging members thus formed were uniformly negatively charged to a surface potential of −142 Volts with a corona charging device and were subsequently optically exposed by placing test pattern masks comprising silver halide images in contact with the imaging members and exposing the members to blue light of 480 nanometers through the mask for a period of 5 seconds. The imaging members were then developed by heating them with an aluminum heating block in contact with the polyester substrates at temperatures of from about 85° to about 100° C. for about 5 seconds. Images corresponding to the images on the test pattern masks were subsequently visible in the developed imaging members. The optical densities of the $D_{max}$ and the $D_{min}$ areas of the migration imaging members were measured with a Macbeth TR927 densitometer in the visible range using a Wratten No. 47 filter for the measurements. The results were as follows:

| Overcoating Material | Solvent | Coating Thickness (microns) | Imaging Results $D_{max}$ | $D_{min}$ | Contrast |
|---|---|---|---|---|---|
| none | — | — | 2.06 | 1.01 | 1.05 |
| hydroxypropyl methyl cellulose phthalate | 80% ethanol 20% water | 3–4 | 2.02 | 1.20 | 0.82 |
| hydroxypropyl methyl cellulose succinate | 80% ethanol 20% water | 3–4 | 1.92 | 1.14 | 0.78 |
| vinyl alcohol/vinyl acetate copolymer | methanol | 3 | 2.05 | 1.05 | 1.00 |
| Hycar 26138 heat reactive acrylic polymer emulsion | latex (polymer suspension or emulsion in water) | 4 | 2.05 | 1.18 | 0.87 |
| Rhoplex AR-74 acrylic-vinyl acetate copolymer emulsion | latex (polymer suspension or emulsion in water) | 3–4 | 1.80 | 1.17 | 0.63 |

As the results indicate, the improved resistance to fingerprints and scratching was obtained with little impairment of optical contrast density.

EXAMPLE II

A migration imaging member was prepared as described in Example I except that the softenable layer contained about 84 percent by weight of the terpolymer of styrene/ethylacrylate/acrylic acid and about 16 percent by weight of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference). N,N'-diphenyl-N,N'-bis(3"-methylphenyl)-(1,1'-biphenyl)-4,4'-diamine is a charge transport material capable of transporting positive charges (holes). Subsequent to coating of the softenable layer and prior to coating of the overcoating layer, an infrared sensitive layer was applied as follows. A pigment dispersion was prepared by ball milling for 24 hours a mixture comprising 10.6 parts by weight solids in a solvent (wherein the solvent comprised 40 percent by weight 2-propanol and 60 percent by weight deionized water), wherein the solids comprised 20 percent by weight X-metal-free phthalocyanine (prepared as described in U.S. Pat. No. 3,357,989 (Byrne et al.), the disclosure of which is totally incorporated by reference) and 80 percent by weight of a styrene-butyl methacrylate copolymer (ICI NEOCRYL A622®). The resulting dispersion was coated onto the softenable layer of the migration imaging member by a solvent extrusion method, followed by drying the deposited infrared-sensitive layer at 50° C. for 1 minute by contacting the polyester substrate to an aluminum heating block.

Thereafter, a solution for an overcoating layer was prepared by dissolving about 5 parts by weight of a vinyl alcohol/vinyl acetate copolymer (#379, obtained from Scientific Polymer Products, Inc., Ontario, N.Y.) in about 95 parts by weight of methanol. The resulting solution was coated by a solvent extrusion technique onto the infrared sensitive layer of the imaging member, and the deposited overcoating layer was allowed to dry at about 115° C. for about 2 minutes, resulting in a dried overcoating layer with a thickness of about 3 microns. The imaging member thus formed was fingerprint and scratch resistant.

Other embodiments and modifications of the present invention may occur to those skilled in the art subsequent to a review of the information presented herein; these embodiments and modifications, as well as equivalents thereof, are also included within the scope of this invention.

What is claimed is:

1. A process which comprises (a) providing a migration imaging member comprising (1) a substrate, and (2) a softenable layer situated on the substrate, said softenable layer comprising a softenable material and a photosensitive migration marking material; (b) applying to the surface of the softenable layer a composition comprising (1) a solvent selected from the group consisting of (A) methanol, (B) ethanol, (C) isopropanol, (D) n-propanol, (E) acetone, (F) water, and (G) mixtures thereof, and (2) an overcoating material selected from the group consisting of poly (hydroxyalkyl methacrylates), poly (hydroxyalkylacrylates), aryl celluloses, hydroxyalkyl cellulose acrylates, hydroxyaryl cellulose acrylates, hydroxyalkyl cellulose methacrylates, hydroxyaryl cellulose methacrylates, cellulose-acrylamide adducts, cyanoethylated celluloses, cellulose acetate hydrogen phthalates, hydroxypropylmethyl cellulose phthalates, hydroxypropyl methyl cellulose succinates, cellulose triacetates, and mixtures thereof; and (c) allowing the solvent to evaporate, thereby forming a layer of the overcoating material on the softenable layer.

2. The process according to claim 1 wherein the softenable material is selected from the group consisting of styrene-acrylic copolymers, polystyrenes, styrene-olefin copolymers, styrene-vinyltoluene copolymers, polyesters, polyurethanes, polycarbonates, polyterpenes, silicone elastomers, and mixtures thereof.

3. The process according to claim 1 wherein the softenable material is selected from the group consisting of styrene-hexylmethacrylate copolymers, styrene acrylate copolymers, styrene butylmethacrylate copolymers, styrene butylacrylate ethylacrylate copolymers, styrene ethylacrylate acrylic acid copolymers, polyalphamethyl styrene, alkyd substituted polystyrenes, styrene-olefin copolymers, styrene-vinyltoluene copolymers, and mixtures thereof.

4. The process according to claim 1 wherein the softenable material is a styrene/ethyl acrylate/acrylic acid terpolymer.

5. The process according to claim 1 wherein the solvent is methanol.

6. The process according to claim 1 wherein the solvent is ethanol.

7. The process according to claim 1 wherein the solvent is isopropanol.

8. The process according to claim 1 wherein the solvent is n-propanol.

9. The process according to claim 1 wherein the solvent is acetone.

10. The process according to claim 1 wherein the solvent is water.

11. The process according to claim 1 wherein the solvent is selected from the group consisting of methanol, ethanol, isopropanol, n-propanol, acetone, and mixtures thereof.

* * * * *